United States Patent [19]

Hashimoto

[11] 4,099,509

[45] Jul. 11, 1978

[54] IGNITION SYSTEMS OF CURRENT INTERRUPTION TYPE FOR INTERNAL COMBUSTION ENGINES

[75] Inventor: Hideyuki Hashimoto, Katsuta, Japan

[73] Assignee: Hitachi, Ltd., Japan

[21] Appl. No.: 699,183

[22] Filed: Jun. 23, 1976

[30] Foreign Application Priority Data

Jul. 4, 1975 [JP] Japan ..... 50-81803

[51] Int. Cl.[2] ..... F02P 1/08

[52] U.S. Cl. ..... 123/148 AC; 123/148 E; 315/209 T; 310/70 A

[58] Field of Search ..... 123/148 E, 149 A, 148 AC, 123/148 F; 315/209 T, 209 M, 218; 310/70 R, 70 A

[56] References Cited

U.S. PATENT DOCUMENTS

| | | | |
|---|---|---|---|
| 2,790,914 | 4/1957 | Dingman | 310/70 R |
| 3,484,677 | 12/1969 | Piteo | 123/148 E |
| 3,878,824 | 4/1975 | Haubner et al. | 123/148 E |

*Primary Examiner*—Samuel Feinberg
*Attorney, Agent, or Firm*—Craig & Antonelli

[57] ABSTRACT

An ignition system of a current interruption type comprises an a.c. power source and an ignition coil, the primary winding of which is connected to the a.c. power source through a controllable switch element for interrupting the current. The ignition system further includes a control circuit for controlling the switch element. The control circuit functions to actuate the switch element in synchronism with the ignition cycle of an internal combustion engine in dependence upon the output of the a.c. power source thereby to interrupt the primary current in the ignition coil and induce a high voltage in the secondary winding thereof.

11 Claims, 4 Drawing Figures

IGNITION SYSTEMS OF CURRENT INTERRUPTION TYPE FOR INTERNAL COMBUSTION ENGINES

BACKGROUND OF THE INVENTION

The present invention relates in general to an ignition system for an internal combustion engine and in particular to an ignition system of a current interruption type in which the primary current in an ignition coil supplied from an a.c. power source is interrupted by a current interrupting element under the control of a suitable control circuit.

Hitherto, there have been generally known a so-called battery ignition system and a magnet ignition system as the current interruption type ignition system for the internal combustion engine of a motor bicycle which is equipped with an a.c. generator.

In the case of the battery ignition system, the carried battery is charged by the output power produced by the a.c. generator and a d.c. current from the battery is supplied to the ignition coil. By interrupting the d.c. current directly through the interrupter, a high voltage is induced in the secondary winding of the ignition coil. As an improved battery ignition system of such a current interruption type, there has been lately proposed a transistorized system, according to which the current from the battery is supplied to the ignition coil through a switching transistor which is controlled by a small current in synchronism with the ignition cycle of the internal combustion engine thereby to interrupt the d.c. current fed to the primary winding of the ignition coil. The ignition system in which the conventional interrupter is employed as a means for producing such a small current for controlling the switching transistor is referred to as the contact-type transistorized ignition system or semi-transitorized ignition system. On the other hand, instead of utilizing such an interrupter, it is known to use for the same purpose an electromagnetic pick-up device comprising a rotatable permanent magnet device provided with magnetic poles in number corresponding to that of the cylinders of the engine and a sensor constituted by a detection coil wound around a core and positioned in opposition to the rotatable magnet device so that the electromotive force is induced in the detection coil in response to the passage of the magnetic poles. This system is often referred to as the contactless-type transistorized ignition system or full-transistorized ignition system.

On the other hand, an ignition system of a fly-wheel type is known as a variety of the magnet type ignition system, in which a so called fly-wheel magnet serving simultaneously as the fly-wheel for the engine constitutes an a.c. generator to supply an a.c. current directly to the ignition coil, which current is interrupted directly by an interrupter thereby to induce a high voltage in the secondary coil of the ignition coil.

In addition to the ignition system of the current interruption type, there has been proposed an ignition system of a capacitor discharge type in which the output current of the a.c. generator of the magnet rotor type or the fly-wheel magnet type is adapted to be temporarily stored in a capacitor which is abruptly discharged through the primary coil of the ignition coil by means of a thyristor enabled by a gate pulse signal. Such an ignition system in which the gate pulse signal is produced by an interrupter is termed as a contact type, while such an ignition system in which an electro-magnetic pick-up device is employed is termed as the contactless type.

In the ignition systems in which the primary current flowing in the ignition coil is directly interrupted by an interrupter, it is known that the contacts of the interrupter are likely to be burnt off due to the produced arc and can not be evaded from the migration phenomenon, involving the lowered voltage induced in the secondary winding of the ignition coil as well as failures in the spark generation, even if the contacts are made of tungsten or the like material. Thus, frequent repair of the contacts is required.

Besides, since the interrupting operation of the interrupter is mechanically controlled by a cam means, there will arise a chattering phenomenon of the contacts of the interrupter at high revolution speeds of the engine even in the case of the capacitor discharge ignition system of the contact type or the semitransistorized type in which the primary current is not interrupted directly. Such chattering phenomenon will of course give rise to an abrupt decrease in the induced secondary voltage.

In view of the disadvantages of the prior art described above, the contactless type ignition system is preferred. However, in order to accomplish such a contactless type ignition system whether of the falltransistorized current interruption variety or the capacitor discharge type, a pulse generator means for producing the gate or control pulse in synchronism with the ignition cycle of the engine is indispensably required. Such pulse generator means which functions properly can not, however, be realized in the case of the motor bicycle not carrying a battery because the output voltage of the generator alternates. For this reason, practical ignition systems of the contactless type have not yet been brought into use at the present technical state.

SUMMARY OF THE INVENTION

Accordingly, a main object of the invention is to provide a current interruption type ignition system for an internal combustion engine in which the supply of the primary current to the ignition coil as well as the control therefor can be effected by utilizing the output of a single a.c. power source or a.c. generator.

With the above object in view, the invention provides an ignition system of the current interruption type which comprises an a.c. power source and an ignition coil having a primary winding connected to the a.c. power source through a controllable switch element for interrupting the current fed to the primary winding. The ignition system according to the invention includes a control circuit which is so arranged that the current interrupting switch element is actuated in synchronism with the ignition cycle of the internal combustion engine in dependence upon the output power of the a.c. power source thereby to interrupt the primary current in the ignition coil in such a manner that a high voltage is induced in the secondary winding of the ignition coil.

The control circuit is preferably so constructed that the lagging of the output current of the a.c. power source relative to the output voltage thereof due to the inductance included in the current path is compensated so that the primary current of the ignition coil can be always interrupted at the peak or maximum value of the output current, whereby the greatest ignition power is available at the spark plug.

DETAILED DESCRIPTION OF THE PREFERRED EMBODIMENTS

Figure 1:
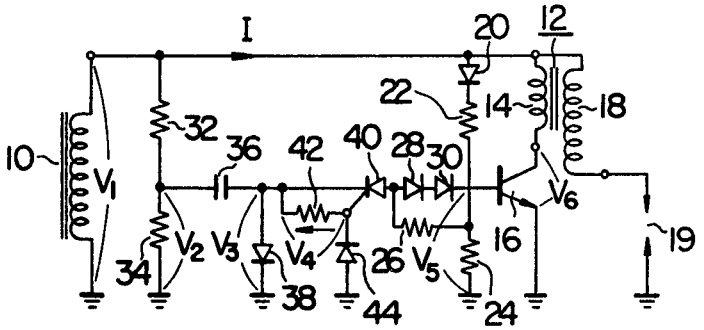
FIG. 1 is a circuit diagram showing an embodiment of the ignition system according to the invention.

Referring to FIG. 1, reference numeral 10 designates an a.c. power source which may be, for example, an a.c. generator such as a fly-wheel magnet or a magnet-rotor generator installed on a motor vehicle such as a motor bicycle. The generator 10 has a generator coil 10 which produces an a.c. output voltage in synchronism with the rotation of an internal combustion engine (not shown). One end of the generator coil 10 is connected to a reference potential such as ground potential, while the other end of the coil 10 is connected to one end of a primary winding 14 of an ignition coil generally indicated by reference numeral 12. The primary winding 14 of the ignition coil 12 has the other end coupled to the ground potential through the collector-emitter path of a transistor 16 which serves for the current interruption. The ignition coil 12 has a secondary winding 18 the output terminal of which is connected to one terminal of an ignition plug 19 having the other terminal grounded. The anode of a diode 20 is connected to the other end of the generator coil 10, while the cathode of the diode 20 is connected to the ground potential through resistors 22 and 24 connected in series. Connected to the junction between the resistors 22 and 24 is a resistor 26 which in turn is connected to the anode of a diode 28 with its cathode connected to the anode of another diode 30. The cathode of the diode 30 in turn is connected to the base of the transistor 16.

The generator coil 10 is shunted through a series connection of resistors 32 and 34, the junction between these resistors being coupled to the anode of a diode 38 through a capacitor 36. The cathode of the diode 38 is connected to the ground potential.

The junction between the capacitor 36 and the diode 38 is on one hand connected to the cathode of a controlled switching element such as thyristor 40 and on the other hand connected to the gate or control electrode of the thyristor 40 through a resistor 42. The gate electrode of the thyristor 40 is connected also to the cathode of a diode 44 with its anode grounded. The anode of the thyristor 40 is connected to the junction between the resistor 26 and the diode 28.

Next, operation of the circuit shown in FIG. 1 and having the above-mentioned circuit arrangement will be described by referring also to FIG. 2.

Figure 2:
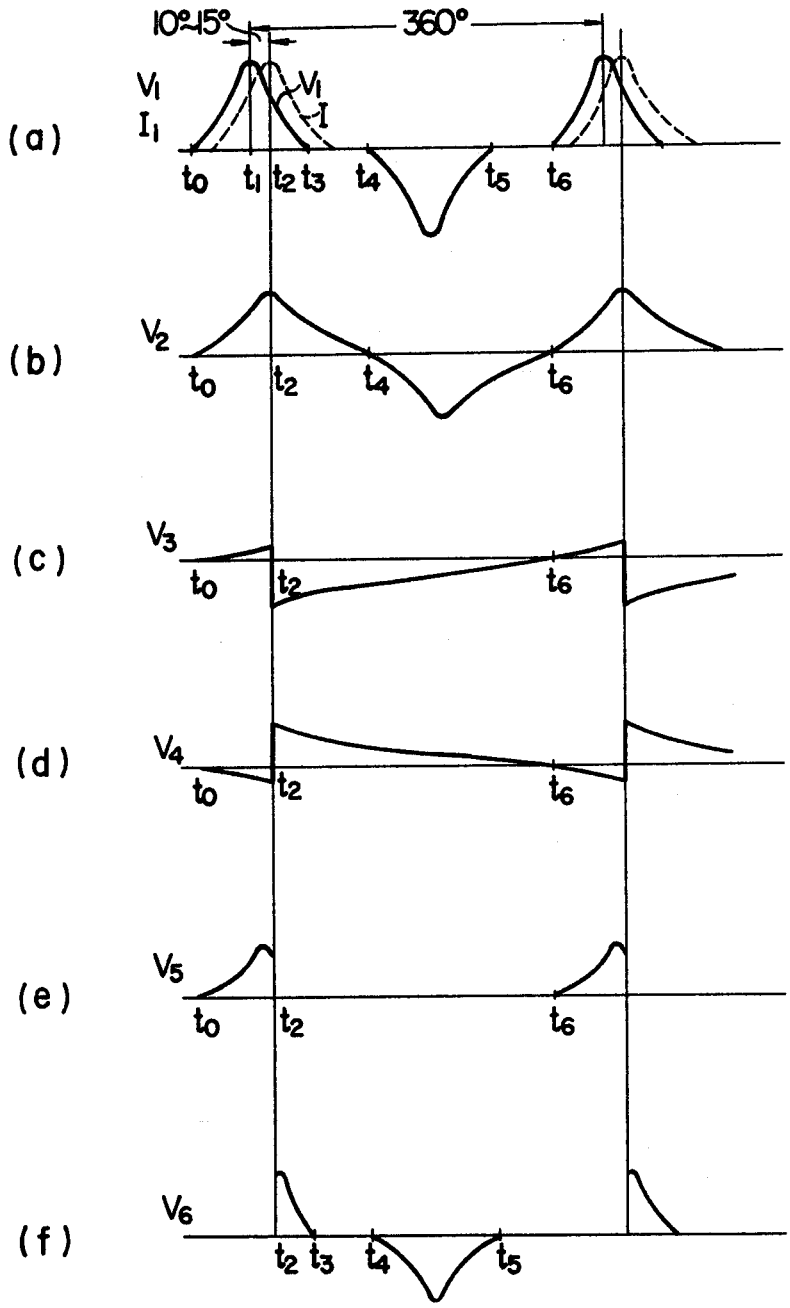
FIG. 2 is a wave-form diagram to illustrate the operation of the circuit shown in FIG. 1.

When the engine is operated, an output voltage $V_1$ such as shown in the wave-form diagram (a) of FIG. 2 is generated in the generator coil 10 in synchronism with the engine revolution. As can be seen from the curve $V_1$ in the wave-form diagram (a), the voltage $V_1$ will begin to rise up at the time $t_0$ and attains a peak level at the time point $t_1$. Thereafter, the voltage $V_1$ will decrease and disappear at the time $t_3$. During the period from the time $t_4$ to $t_5$, the voltage $V_1$ swings in the negative direction, and a new cycle will begin at the time point $t_6$.

Starting from the time point $t_0$, the output voltage $V_1$ from the generator coil 10 is applied to the voltage divider resistors 22 and 24 through the diode 20, so that the current tapped at the junction between these resistors 22 and 24 is fed to the base of the transistor 16 through the resistor 26 and the diodes 28 and 30. The transistor 16 is then turned on and the current I will begin to flow through the primary winding 14 of the ignition coil 12. It will be noted that the diode 20 serves to rectify the output voltage $V_1$ thereby to pass only the positive half waves of the voltage $V_1$ to the divider circuit consisting of the resistors 22 and 24. The diodes 28 and 30 are employed with a view to compensating for the forward voltage drop at the thyristor 40 and the diode 38.

The output current I attains a peak value at the time point $t_2$ which is delayed for 10° to 15° relative to the time point $t_1$ at which the output voltage $V_1$ becomes maximum because of the inductance included in the current path. In this connection, it should be noted that the condition for producing the spark of the greatest intensity at the ignition plug 19 resides in that the transistor 16 be turned off to interrupt the primary current at the moment when the current I just attains the peak value.

The output voltage $V_1$ is also applied to the divider circuit consisting of the resistors 32 and 34. Consequently, a current flows through these resistors to the earth and on the other hand through an integrator circuitry constituted by the resistor 32, the capacitor 36 and the diode 38 to the earth, charging the capacitor 36. This will result in a voltage drop $V_2$ across the resistor 32, which has such a wave-form (*b*) as shown in FIG. 2. It should be appreciated that the circuit elements are so dimensioned that the peak time of the voltage $V_2$ coincides with the peak time $t_2$ of the generator output current I. After having attained the peak value, the voltage $V_2$ will begin to decrease, as the voltage $V_2$ is decreased. However, at that time, the capacitor 36 simultaneously begins to discharge through the closed circuit of the resistor 34, the diode 44 and the resistor 42. In this connection, the capacitor 36 and the resistor 34 may be regarded to constitute a differentiating circuit. The discharge of the capacitor 36 will continue until the voltage $v_1$ assumes a negative value at the time point $t_4$. When this occurs, current flows on the one hand through the resistors 34 and 32 and on the other hand through the diode 44, the resistor 42, the capacitor 36 and the resistor 32, as a result of which the capacitor 36 is charged with the inverse polarity. Thus, such a negative voltage drop as shown in the wave-form diagram (*b*) of FIG. 2 is produced across the resistor 34. The voltage $V_2$ will be maintained negative until the time point $t_6$.

Next, consideration is made on the voltage $V_3$ across the diode 38. Since the voltage $V_3$ corresponds to the voltage drop across the diode 38 in the forward direction during the period from $t_0$ to $t_2$, the magnitude of the voltage $V_3$ is as low as to be negligible, as shown in the wave-form diagram (*c*) of FIG. 2. At the time point $t_2$ at which the voltage $V_2$ across the resistor 34 attains the peak level, the capacitor 36 will begins to discharge as described hereinbefore. This results in the inversion of the polarity of the voltage $V_3$ the absolute value of which will then substantially correspond to the voltage drop in the resistor 42 due to the discharge current from the capacitor 36. As can be easily appreciated from the wave-form diagram (*c*) of FIG. 2, the voltage $V_3$ continues to be negative during the period from the time point $t_2$ to $t_6$ during which the current flows through the resistor 42 in the direction indicated by arrow in FIG. 1.

On the other hand, voltage $V_4$ across the resistor 42 will appear in the wave-form (*d*) shown in FIG. 2, assuming that the arrow shown in FIG. 1 represents the positive direction of the voltage $V_4$. In other words, the voltage $V_4$ takes negative values during the time span from $t_0$ to $t_2$ and the values are as low as to be negligible, since the voltage $V_4$ corresponds substantially to the voltage drop in the diode 44 caused by the small current flowing therethrough in the reverse direction. However, as soon as the capacitor 36 begins to discharge at the time $t_2$, a relative large voltage drop in the positive direction will be produced in the resistor 42, since the discharge current will flow therethrough in the direction indicated by the arrow shown in FIG. 1. This current flows in the positive direction and hence the positive voltage drop will be maintained until the time point $t_6$ even after the polarity of the source voltage $V_1$ is inverted, as described hereinbefore. When the voltage $V_4$ varies in its polarity from negative to positive at the time $t_2$, the potential at the gate or control electrode of the thyristor 40 will immediately become higher than that of the cathode electrode, as a result of which the thyristor 40 previously applied with the forward voltage across the anode and the cathode is turned on. Thus, the current which has been fed to the base of the transistor 16 through the diode 20, the resistors 22 and 26 and the diodes 28 and 30 is shunted to the ground through the thyristor 40 and the diode 38. Consequently, the transistor 16 is immediately turned off to interrupt abruptly the current flowing through the primary winding 14 of the ignition coil 12, whereby a high voltage is induced in the secondary winding 18 of the ignition coil 12 to give rise to the production of a spark at the plug 19.

Although the voltage $V_4$ remains positive until the time point $t_6$, the voltage applied between the anode and the cathode of the thyristor 40 will become zero at the time $t_3$, will become negative during the time span from $t_4$ to $t_5$ and resume zero level during the period from $t_5$ to $t_6$. Accordingly, the non-conducting state of the thyristor 40 as brought about at $t_3$ will be maintained until the succeeding cycle.

The base voltage of the transistor 16 will take the wave-form (*e*) as shown in FIG. 2. More in particular, since the output voltage $V_1$ is positive during the time span from $t_0$ to $t_2$, the transistor 16 is turned on with the positive voltage $V_5$ appearing at the base thereof due to the current applied thereto through the diode 20, resistors 22 and 26 and the diodes 28 and 30, as hereinbefore described. At the time point $t_2$ at which the thyristor 40 is turned on, the base potential of the transistor 16 will become zero. This state will be maintained until the thyristor 40 is turned off at the time point $t_3$. The zero level of the base voltage $V_5$ is still maintained since the output voltage $V_1$ remains zero until the time point $t_4$. Further, because the output voltage $V_1$ becomes negative during the time span from $t_4$ to $t_5$ thereby to prevent the current from flowing through the blocking diode 20, the base voltage $V_5$ will continue to remain zero until the time point $t_6$. In this manner, the transistor 16 is enabled to be conductive only during the period from $t_0$ to $t_2$. The transistor 16 is turned off at the time point $t_2$ and remains non-conductive until the starting time point $t_6$ of the succeeding cycle. As a result of this, voltage $V_6$ of the wave-form (*f*) as shown in FIG. 2 will appear between the collector and the emitter of the transistor 16.

As will be appreciated from the above description, it is possible according to the invention to interrupt the primary current I of the ignition coil 12 at the time when it attains the peak value, thereby to produce the spark of the greatest intensity at the plug 19.

In general, the ignition system for an internal combustion engine requires following spark characteristics: In the case of a spark plug utilizing three-electrodes, the spark gap of 5 mm is required for the low resolution range of the engine (e.g. 500 to 700 r.p.m.), while in the intermediate revolution range (e.g. up to 3000 r.p.m.) the spark gap of 8 to 10 mm is required. In the high speed range (e.g. higher than 3000 r.p.m.), the spark gap has to be greater than 10 mm.

Figure 3:
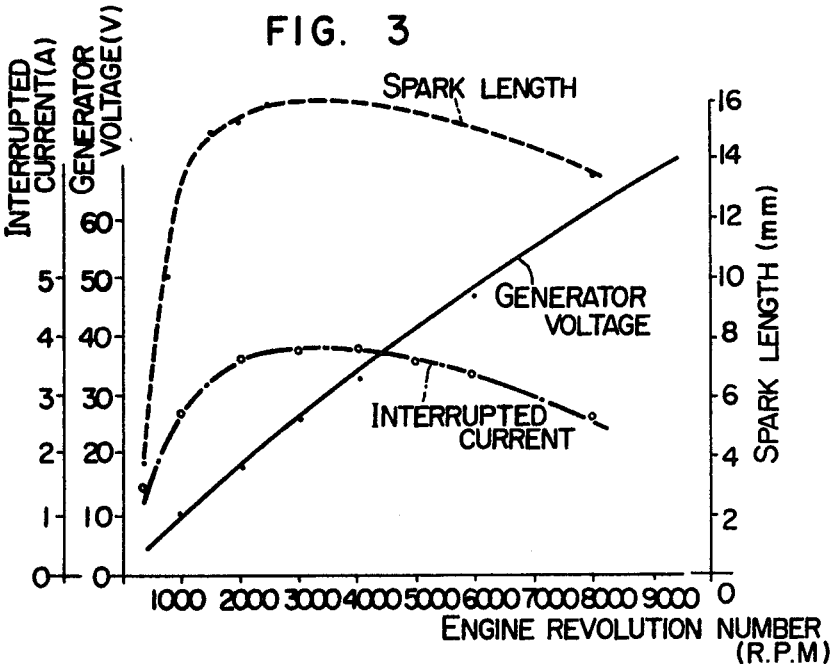
FIG. 3 shows graphically the characteristics of the interrupted current, the source or generator output voltage and the produced spark relative to the engine revolution number.

When the operation characteristics of the embodiment described above was examined, results such as shown in FIG. 3 could be obtained. As can be seen from FIG. 3, the generated voltage of the a.c. generator was 10 volts at the engine revolution number of 1000 r.p.m. and 63 volts at 8000 r.p.m. The cut off current of the transistor 16 was 2.8 A at the engine revolution number of 1000 r.p.m. and attained the peak value of 3.8 A at 300 r.p.m. In the range of higher revolution number, the current decreased due to the inductance and was 2.8 A at 8000 r.p.m.

The length of the spark produced at the ignition plug 19 was 13.5 mm, 16 mm and 13.5 mm at the revolution numbers of 1000 r.p.m., 3000 r.p.m. and 8000 r.p.m., respectively. These values obviously satisfy fully the aforementioned length requirement of the spark gaps and show that the ignition system according to the invention exhibits an excellent performance.

Figure 4:
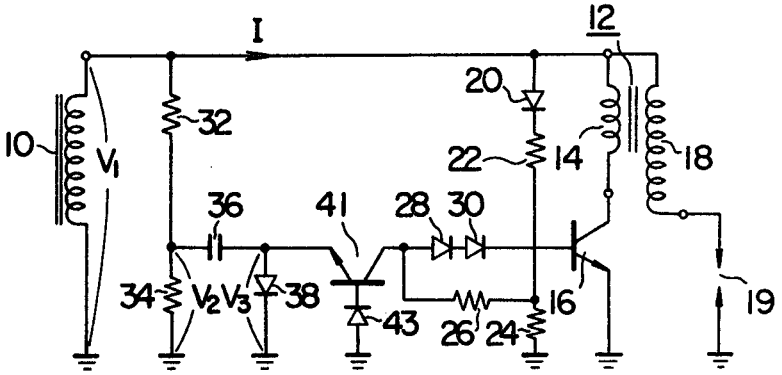
FIG. 4 shows another embodiment of the ignition system according to the invention.

FIG. 4 shows another preferred embodiment of the invention. In the figure, the components having the same function as those shown in FIG. 1 are attached with the same reference numerals. The embodiment shown in FIG. 4 differs from the one shown in FIG. 1 mainly in that a switching transistor 41 is used in place of the thyristor 40 of the ignition system shown in FIG. 1. Referring to FIG. 4, the collector of the transistor 41 is connected to the junction between the resistor 26 and the diode 28, while the emitter thereof is connected to the junction between the capacitor 36 and the diode 38. Further, in place of the diode 44 and the resistor 42 for supplying a gate voltage to the thyristor 40 of the circuit shown in FIG. 1, a diode 43 for supplying the base bias voltage to the transistor 41 is connected between the base of the transistor 41 and the ground with the anode thereof being connected to the ground. The operation of the ignition system shown in FIG. 4 is substantially the same as that of the one shown in FIG. 1.

Describing briefly the operation of the embodiment shown in FIG. 4 with the aid of the wave-form diagram of FIG. 2, voltage $V_1$ of positive polarity will be produced in the generator coil 10 from the time point $t_0$ on the engine is started. Thus, current will flow through the resistors 32 and 34 on one hand and through the resistor 32, the capacitor 36 and the diode 38 on the other hand to charge the capacitor 36, whereby voltage $V_2$ will appear across the resistor 34 due to the voltage drop, as described hereinbefore. However, since no current is fed to the base of the transistor 41 through the diode 43, the transistor 41 remains in the non-conductive state. Accordingly, the transistor 16 is maintained in the conductive state to allow the flowing of the primary current I in the ignition coil 12 in quite a similar manner as in the case of the ignition circuit shown in FIG. 1. At the time point $t_2$ at which the primary current attains the peak value, the voltage $V_2$ becomes also maximum and the capacitor 36 begins to discharge through the resistor 34 and the diode 43, as a result of which current is supplied to the base of the transistor 41 to turn on the latter. When the transistor 41 is turned on, the current fed to the base of the transistor 16 through the diode 20, the resistors 22 and 26 and the diodes 28 and 30 is shunted to the ground through the collector-emitter path of the transistor 41 and the diode 38. Consequently, the transistor 16 is turned off to abruptly interrupt the primary current I, whereby a high voltage is induced in the secondary winding 18 of the ignition coil to produce a spark at the gap 19.

It will be easily understood that the transistor 41 is turned off at the time point $t_3$ as is in the case of the thyristor 40 shown in FIG. 1 and maintained in the non-conductive state until it is again turned on at the time $t_6$.

From the foregoing description, it will be appreciated that the invention provides a contactless ignition system of current interruption type which allows the interruption of the primary current in the ignition coil at the peak value thereof to produce an intense spark by compensating for the lag in phase of the output current relative to the output voltage of an a.c. generator through a suitable combination of resistors and capacitor, thus eliminating the necessity of a pulse generator circuit. The ignition system according to the invention can be manufactured at low costs, has a long use life and requires no special maintenance.

I claim:

1. An ignition system of a current interrupting type for an internal combustion engine, comprising:

an a.c. power source, an ignition coil including a primary winding connected to said a.c. power source, a controlled switch element for interrupting the current flowing through said primary winding, and a control means for operating said controlled switch element thereby to interrupt the current fed to said primary coil in synchronism with a required ignition cycle of said engine in dependence on the output of said a.c. power source, said control means including means for synchronizing said current interrupting operation of said switch element with occurrence of peak value of the output current from said a.c. power source, said synchronizing means including a capacitor, a charging circuit for coupling said capacitor across the output of said a.c. power source to charge said capacitor with said output current and a discharging circuit coupled to said capacitor for discharging the same, said discharging circuit being adapted to be actuated in response to the occurrence of the peak of said output current from said a.c. power source thereby to initiate the discharge of said capacitor, and wherein said control means includes a semiconductor switching element connected between said capacitor and said switch element for the current interruption, said semiconductor switching element being so arranged as to respond to the operation of said discharging circuit thereby actuating said current interrupting switch element to effect the current interruption.

2. An ignition system as set forth in claim 1, wherein said current interrupting switch element is composed of a first transistor having a collector-emitter path through which the current is fed to said primary winding of said ignition coil, said control means includes a bias means for applying a bias voltage to the base of said first transistor for turning on said transistor during the period in which the output voltage of said a.c. power source remains positive, and wherein said semiconductor switching element is composed of a controlled rectifier element connected to the base of said first transistor and adapted to be triggered by a trigger means included in said control means, said trigger means being adapted to respond to the operation of said discharging circuit for triggering said controlled rectifier element, whereby said biasing means is made ineffective thereby to turn off said first transistor.

3. An ignition system as set forth in claim 1, wherein said current interruption switch element is composed of a first transistor having collector-emitter path through which the current from said a.c. power source is fed to the primary winding of said ignition coil, said control means includes a first biasing means for applying a bias voltage to the base of said first transistor to make it conductive during the period in which the output voltage of said a.c. power source remains positive, said semiconductor switching element is composed of a second transistor connected to the base of said first transistor, and wherein said control means further includes a second bias means which is adapted to be operated in response to the operation of said discharging circuit thereby to turn on said second transistor, whereby said first bias means is made ineffective to turn off said first transistor.

4. An ignition system as set forth in claim 2, wherein said charging circuit connected across the output of said a.c. power source is composed of a series connection of a first resistor, said capacitor and a first rectifier element, while said discharging circuit is composed of a closed circuit including said capacitor, a second resistor, a second rectifier element and a third resistor, said first and second resistors being connected in series to each other to form a voltage divider circuit connected across the output of said a.c. power source and so arranged that the peak voltage appearing at a terminal of said second resistor is synchronous with the peak of said output current from said a.c. power source, and wherein the anode of said controlled rectifier element is connected to the base of said transistor, while the cathode thereof is connected to a junction between said capacitor and said first rectifier element, and said third resistor is connected to the cathode and the control electrode of said controlled rectifier element.

5. An ignition system as set forth in claim 3, wherein said charging circuit connected across the output of said a.c. power source is composed of a series connection of said capacitor and a first rectifier element, while said discharging circuit is composed of a closed path including said capacitor, a second resistor, a second rectifier element and said second transistor, said first and second resistors being connected in series to each other to form a voltage divider circuit connected across the output of said a.c. power source and so arranged that the peak voltage appearing at a terminal of said second resistor is synchronous with the peak of the output current of said a.c. power source, and wherein the collector-emitter path of said second transistor is connected between the base of said first transistor and a junction between said first rectifier element and said capacitor, while said second rectifier element is connected to the base of said second transistor.

6. An ignition system of a current interrupting type for an internal combustion engine comprising an a.c. power source, an ignition coil including a primary winding connected across said a.c. power source, a controlled switch element for interrupting the current flowing through said primary winding, and a control means for operating said controlled switch element thereby to interrupt the current fed to said primary coil in synchronism with a required ignition cycle of said engine in dependence on the output of said a.c. power source, wherein said control means includes voltage dividing resistor means connected across said a.c. power source, a capacitor, means connected across a part of said voltage dividing resistor means for charging said capacitor, means coupled to said capacitor for discharging said capacitor, said discharging means initiating the discharge operation from the time when the voltage drop across said part of said voltage dividing resistor means begins to decrease below the charged voltage across said capacitor, and means for actuating said controlled switch element to interrupt the current flowing through said primary winding in response to the initiation of the discharge operation.

7. An ignition system as set forth in claim 6, wherein said controlled switch element actuating means is a semiconductor switching element which is actuated in response to the initiation of the discharge operation to actuate said controlled switch element to effect the current interrupting operation.

8. An ignition system as set forth in claim 7, wherein said controlled switch element is composed of a first transistor having a collector-emitter path through which the current is fed to said primary winding of said ignition coil, and said semiconductor switching element is composed of a controlled rectifier element connected to the base of said first transistor, and wherein said control means includes a bias means coupled to said a.c. power source for applying a bias voltage to the base of said first transistor for turning on said transistor during the period in which the output voltage of said a.c. power source remains positive, and a trigger means coupled to said discharging means for triggering said controlled rectifier element in response to the initiation of the discharge operation.

9. An ignition system as set forth in claim 7, wherein said controlled switch element is composed of a first transistor having a collector-emitter path through which the current from said a.c. power source is fed to the primary winding of said ignition coil, and said semiconductor switching element is composed of a second transistor connected to the base of said first transistor, and wherein said control means includes a first bias means coupled to said a.c. power source for applying a bias voltage to the base of said first transistor to make it conductive during the period in which the output voltage of said a.c. power source remains positive, and a second bias means coupled to said discharge means for rendering said second transistor conductive in response to the initiation of the discharge operation thereby rendering said first bias means ineffective to turn off said first transistor.

10. An ignition system as set forth in claim 8, wherein said voltage dividing resistor means includes a series circuit of a first and a second resistor, said series circuit of said first and said second resistors being connected across said a.c. power source, wherein said charging circuit includes a first rectifier element connected in series with said capacitor, the series circuit of said capacitor and said first rectifier element being connected across said second resistor thereby enabling a charging current to flow through said first resistor, said capacitor, and said first rectifier element from said a.c. power source, and wherein said discharging circuit includes a second rectifier element and a third resistor, said capacitor, said second resistor, said second rectifier element and said third resistor being connected in series to form a closed path to enable a discharging current to flow through said closed path, and wherein the anode of said controlled rectifier element is connected to the base of said transistor, while the cathode thereof is connected to a junction between said capacitor and said first rectifier element, and said third resistor is connected between the cathode and the control electrode of said controlled rectifier element.

11. An ignition system as set forth in claim 9, wherein said voltage dividing resistor means includes a series circuit of a first and a second resistor, said series circuit of said first and said second resistors being connected across said a.c. power source, wherein said charging circuit includes a first rectifier element connected in series to said capacitor, the series connection of said capacitor and said first rectifier element being connected across said second resistor thereby enabling a charging current to flow through said first resistor, said capacitor, and said first rectifier element from said a.c. power source, and wherein said discharging circuit includes a second rectifier element, said capacitor, said second resistor, said second rectifier element and said second transistor being connected in series to form a closed path to enable a discharging current to flow through said closed path, and wherein the collector-emitter path of said second transistor is connected between the base of said first transistor and a junction between said first rectifier element and said capacitor, while said second rectifier element is connected between the base of said second transistor and said second resistor.

* * * * *